United States Patent [19]

Estes

[11] 4,170,045

[45] Oct. 9, 1979

[54] HOSPITAL BATHTUB

[76] Inventor: Judith K. Estes, 726 Ingleside, Flint, Mich. 48507

[21] Appl. No.: 914,025

[22] Filed: Jun. 9, 1978

[51] Int. Cl.[2] ..... A47K 3/06

[52] U.S. Cl. ..... 4/177 R; 4/177 CW; 4/178

[58] Field of Search ..... 4/177, 173, 175, 178, 4/185 R, 177 CW

[56] References Cited

U.S. PATENT DOCUMENTS

| | | | |
|---|---|---|---|
| 2,645,786 | 7/1953 | Loftin | 4/177 X |
| 2,698,948 | 1/1955 | Levitt | 4/177 |
| 3,670,347 | 6/1972 | Weinstein | 4/177X |
| 3,681,789 | 8/1972 | Bott | 4/177 |
| 3,755,830 | 9/1973 | Johns | 4/177 |
| 4,051,563 | 10/1977 | Clarke | 4/173 R |

*Primary Examiner*—Henry K. Artis

*Attorney, Agent, or Firm*—Basile and Weintraub

[57] ABSTRACT

A contoured inner bathing tub or litter having a multiplicity of perforations or apertures formed therein is removably positioned within a complementarily contoured outer tub. The outer tub is supported on a mobile frame. The present invention permits a patient to be easily positioned on the litter and, then, bathed while resting stationary and in a natural position within the inner tub. The perforations enable the bathing liquid to enter the litter for washing the patient.

8 Claims, 6 Drawing Figures

FIG-1
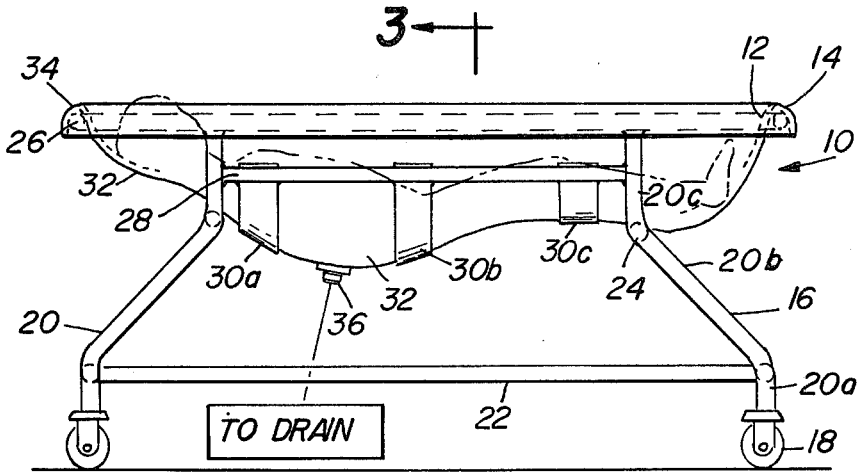
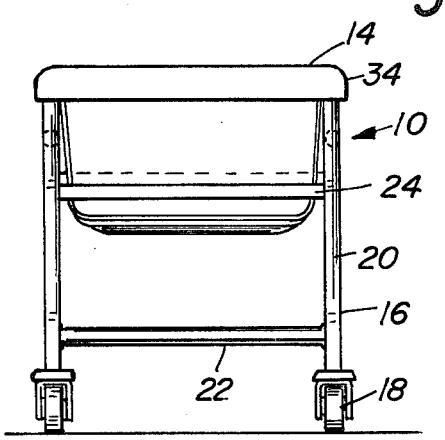
FIG-2
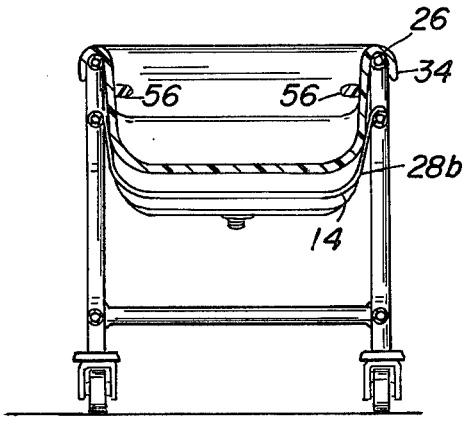
FIG-3
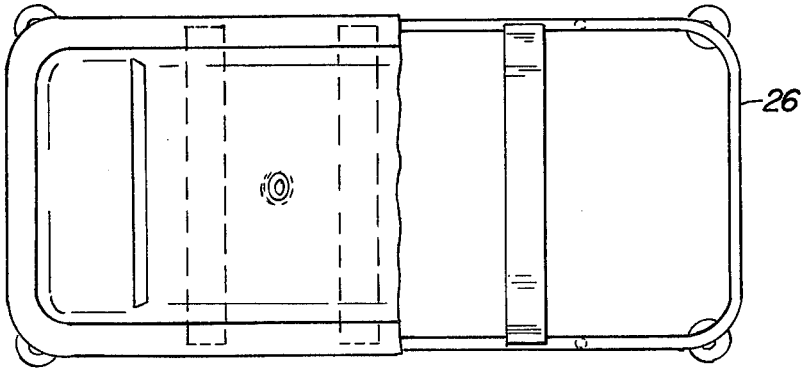
FIG-4

HOSPITAL BATHTUB

BACKGROUND OF THE INVENTION

1. Field of the Invention

The present invention pertains to bathing devices. More particularly, the present invention pertains to bathing devices for bedridden or otherwise immobile persons. Even more particularly, the present invention pertains to movable bathing devices for bedridden or otherwise immobile persons which permit the patient to be bathed while supported within a contoured form.

2. Prior Art

Administering baths to bedridden patients has long been a tedious and difficult chore for attending personnel as well as a source of considerable discomfort for the patient. Transferring the patient into a conventional bathtub presents great physical hazards and difficulties. Bed baths, while not physically hazardous, are generally messy and unpleasant for the attendant as well as for the patient, and are, moreover, less efficacious then those bathing techniques in which the body is immersed in the bathing waters.

The prior art contains several devices intended to combine the physical safety of a bed bath with the benefits of total immersion into the bathing solution. However, the equipment disclosed in the prior art is cumbersome and requires operational skill.

Other tubs and apparatus of the prior art provide either for only partial immersion, or for immersion by means of cumbersome hydraulic equipment. In all cases, the patient is suspended on a flat or angular support structure disposed within the tub.

Therefore, considerable benefits would be provided by a hospital bathtub which would permit total immersion of a patient into bathing solutions without the use of hydraulic lifting equipment. Further advantages would be realized by providing a hospital-type bathtub into which patients may be transferred easily, and which would provide patients the pleasurable and restful experience of being bathed, totally immersed, in a contoured tub, having no artificial support members therein.

STATEMENT OF RELEVANT ART

To the best of applicants knowledge, the most relevant art is found in the following:

U.S. Pat. No. 2,603,796
U.S. Pat. No. 3,778,848
U.S. Pat. No. 3,822,421
U.S. Pat. No. 3,842,449

SUMMARY OF THE INVENTION

In accordance with the present invention, there is provided a bath tub assembly comprising: (a) an inner tub, (b) an outer tub, and (c) a support frame.

The inner tub or litter, which is contoured to a human configuration, is provided with a multiplicity of perforations to enable bathing waters to enter the litter. Handles formed integrally with the litter facilitate its use for transfer of the patient from bed to bath.

The outer tub is complimentarily configured to the inner tub and is supported on the frame. The bathing waters are stored within the outer tub. Means defining a drain enable removal of the dirty bath waters from the outer tub.

In use, a patient to be bathed is transferred from bed onto the contoured inner tub. The inner tub is lowered into the outer tub. Bathing waters enter the inner tub through the perforations provided therein, thus enabling bathing of the patient within an easily manipulated tub.

Other advantages of the present invention will be readily appreciated as the same becomes better understood by reference to the following detailed description when considered in connection with the accompanying drawing wherein like reference characters refer to like parts throughout the several views in which:

BRIEF DESCRIPTION OF THE DRAWING

FIG. 1 is a side elevational view, partly in phantom, of a bathtub in accordance herewith and depicting a patient lying therewithin;

FIG. 2 is an end elevational view, partly in phantom of the present invention;

FIG. 3 is a cross-sectional view of the present invention taken along line 3—3 of FIG. 1;

FIG. 4 is a top plan view, partially broken, of a tub in accordance with the present invention;

DESCRIPTION OF THE PREFERRED EMBODIMENT

Figure 5:
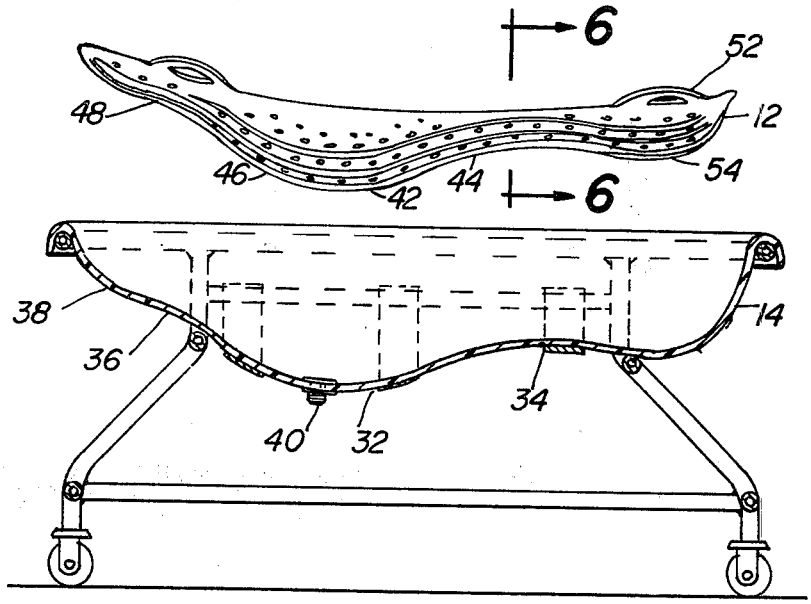
FIG. 5 is a exploded, side elevational view, partly in cross-section and partly in phantom, of the present invention.

Now, and with reference to the drawing, a bathtub for bathing bedridden patients or the like is shown generally at 10. The bathtub hereof comprises an inner tub 12, an outer tub 14 and a frame 16.

The frame 16 comprises a plurality of legs 20, mounted on coasters 18, to render the frame movable. Conventional coaster locks (not shown) may be used to render the frame immovable, when desired. Support rods 22, interconnect and extend between the legs 20 for structural stability, as shown.

End stabilizer rods 24 extend between the legs 20 at each end of the device, above the support rods 22, as shown.

Although the legs and stabilizers can have any desired configuration, it is preferred that the frame legs 20 be formed in three sections. A lower section **20*a*, extends vertically upwardly from an associted coaster 18. An intermediate section 20*b*, is angularly disposed relative to section 20*a* and extends inwardly therefrom toward the center of the frame, between rods 22 and 24. An upper section 20*c*, extends upwardly from section 20*b* from the associated stabilizer rod 24 and the rail 26**. This preferred configuration maximizes the safety of the bathtub by providing a wide base and stability to the frame.

A pair of spaced apart, parallel side rails 28, are disposed laterally, on each side of the frame. Each rail extends between a pair of legs 20 at a point intermediate the rail 26 and support rods 24.

A plurality of straps, 30 transverse the interior of the frame and have the outer tub 14 supported thereon. The ends of each strap are affixed to side rail 28. Each strap has a length dictated by the contour of the outer tub 14 and the position of the strap relative thereto, in order to support and maintain the outer tub in a fixed, horizontal position.

As best illustrated in FIG. 5, the outer tub 14 is a unitary member, preferably formed from a lightweight, inexpensive, material such as fiberglass or a durable plastic. The outer tub 14 is contoured to provide maximum immersion and comfort for a user. The outer tub 14 includes a volume of greatest depth 32, a region coinciding, generally, with a user's lower torso; a support area 34, defining a support for the lower extremeties of a user; a raised back support portion 36, and a headrest position 38.

The outer tub 14 is further provided with a drain means 40 for draining bathing waters therefrom. It is to be, thus, appreciated that the outer tub defines a bathing water receptacle.

The inner tub 12 is integrally formed, preferably, from a lightweight inexpensive material such as fiberglass or a durable plastic material, and is so contoured as to complement and fit easily into the outer tub 14. It is to be understood that the outer tub 14 is of greater depth than the inner tub 12, however, both tubs have essentially identical contour, thereby providing a stable and secure removable emplacement of the inner tub within the outer tub, as a lining, when in use. Thus, contour of said inner tub 12 provides identically maximum immersion of the patient's torso. Thus, the tub has a region of greatest depth 42; a lower extremity support region 44; a raised back support portion 46 and a headrest 48. In addition, arm rests 50 may be formed on each side of the inner tub, along the interior surface thereof without altering the outer contour thereof.

At least one handle 52, (four of which are shown) is disposed on the inner tub. The handle 52 permits the inner tub to be used as a litter to transfer the patient from bed to bath.

Figure 6:
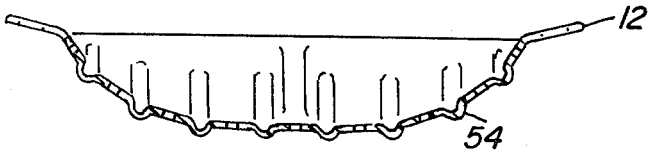
FIG. 6 is a cross-sectional view of the inner tub of the present invention taken along line 6—6 of FIG. 5.

As best illustrated in FIGS. 5 and 6, the inner tub 12 has disposed therethrough a plurality of perforations, generally, indiated at 54, which permit the water or bathing solution in the outer tub 14 to enter the inner tub 12 and envelop the patient. Preferable, the perforations 54 will be disposed within grooves 56 extending linearly along the inner tub 12. The deployment of the perforations 52 within linear grooves 56 maximizes the efficiency of the drainage.

In operation, the outer tub portion 14, in its frame 16, is filled with water, or other washing solution, at any convenient location. The water filled outer tub 14 in its frame 16, can then be welded into the patient's room or any other desirable bathing location. The patient will than be transfered from his bed into the inner tub 12. The transfer of the patient into the inner tub is facilitated by the light weight of same which permits it to be handled easily as one would a litter. When the patient is comfortably situated within the inner tub 12, it may then be lifted by means of its handles 52 and lowered into the outer tub 14. The water in the outer tub will seep through the perforations 52 provided in the inner tub, eveloping the patient.

When the bathing procedure has been completed, the water may be drained out of the tub by the means 40. Alternatively, the inner tub 12 may be lifted out of the outer tub 14, by means of its handles 52. As the inner tub is lifted from the outer tub, the water will drain out of the inner tub through the perforations provided therein, and the inner tub and patient may then be transferred to an other location for drying. The patient may then be transferred back to his bed, this operation, again, being facilitated by the lightweight and adaptability of the inner tub.

Having, thus, described the invention what is claimed is:

1. A hospital bathtub, comprising:

(a) a supporting frame;

(b) an outer tub supported on the frame and mounted thereonto the tub being contoured to define its greatest depth at a user's torso, the tub including a lower extremity support area, a raised back support portion and a head rest, the outer tub adapted for storing a bathing solution therewithin, and (c) an inner tub removably seatable within and supported by the outer tub and having a contour substantially identical to that of said outer tub, the inner tub having a plurality of perforations formed along the bottom thereof, the bathing solution being capable of entering the inner tub through the perforations.

2. The bathtub of claim 1 wherein said inner tub further comprises means defining a handle secured thereto.

3. The bathtub of claim 1 wherein said inner tub further comprises arm rests formed therewith.

4. The bathtub of claim 1 wherein said plurality of perforations are disposed within a plurality of linear grooves which are deployed along the bottom of said inner tub.

5. The bathtub of claim 1 wherein said supporting frame comprises wheels for moving said frame.

6. The bathtub of claim 1 wherein the outer tub further comprises: means for draining solution therefrom.

7. The bathtub of claim 1 wherein the support frame comprises:

(a) a plurality of corner legs, (b) lateral side rails interconnecting the legs, and (c) a plurality of straps extending between the side rails, and wherein the outer tub is supported on the straps.

8. The bathtub of claim 1 wherein:

the inner tub defines a litter for transporting a user to and from the outer tub.

* * * * *